United States Patent [19]

Mikiya

[11] Patent Number: 4,601,350

[45] Date of Patent: Jul. 22, 1986

[54] ELECTRICALLY-OPERATED MULTI-NEEDLE CHISEL TOOL

[76] Inventor: Toshio Mikiya, 9-17, Todoroki 1-chome, Setagaya-ku, Tokyo, Japan

[21] Appl. No.: 608,362

[22] Filed: May 9, 1984

[30] Foreign Application Priority Data

May 14, 1983 [JP] Japan ..... 58-72211[U]

[51] Int. Cl.[4] ..... B21D 41/00

[52] U.S. Cl. ..... 173/117; 173/121; 173/122; 29/81 D

[58] Field of Search ..... 173/114, 132, 117, 122, 173/119, 121; 29/81 D

[56] References Cited

U.S. PATENT DOCUMENTS

| | | | |
|---|---|---|---|
| 2,588,360 | 3/1952 | Cole | 173/122 |
| 2,917,025 | 12/1959 | Dulanez | 173/119 |
| 3,409,091 | 11/1968 | Bardwell | 173/119 |
| 3,937,055 | 2/1976 | Caruso et al. | 173/132 X |

FOREIGN PATENT DOCUMENTS

| | | | |
|---|---|---|---|
| 1078960 | 8/1967 | United Kingdom | 29/81 D |

*Primary Examiner*—E. R. Kazenske
*Assistant Examiner*—Willmon Fridie, Jr.
*Attorney, Agent, or Firm*—Birch, Stewart, Kolasch & Birch

[57] ABSTRACT

An electrically-operated multi-needle chisel tool including a housing having a front portion and a rear portion. An electric motor is mounted in the rear portion. A cylinder extends forwardly from the front portion of the housing. A piston is disposed in said cylinder for reciprocable linear motion which is converted from the rotary motion of the motor. An anvil is axially slidably supported in the cylinder and positioned forward of the piston so as to be hit by the piston. A needle supporter is axially slidably supported in the cylinder and positioned forward of the anvil so as to be hit by the anvil. A number of needle chisels are individually supported by the needle supporter for axially slidable movement, and a return spring disposed in the cylinder for returning the needle supporter, the piston, the anvil and the needle supporter being adapted to be synchronously reciprocated by the motor. The piston includes a base portion and a reduced diameter shaft portion extending forwardly from the base portion. A hollow generally cylindrical hammer is axially slidably fitted over the fore end portion of the shaft portion of the piston in opposed relation to the anvil. A buffer compression spring is disposed around the shaft portion between the base portion of the piston and the rear end of the hammer.

3 Claims, 2 Drawing Figures

ELECTRICALLY-OPERATED MULTI-NEEDLE CHISEL TOOL

BACKGROUND OF THE INVENTION

The present invention relates to an electrically-operated multi-needle chisel tool including a number of needle chisels extending from the forward end of the tool which are adapted to be vigorously moved to and fro to remove the rust from metal surfaces, weld spatters, foundry sand and the like or to grind the surfaces of stone and concrete materials.

As disclosed in Japanese Patent Application Publication No. 42-5512 (1967), the electrically-operated multi-needle chisel tool generally comprises a housing having a front portion and a rear portion, an electric motor mounted in said rear portion, a cylinder means extending forwardly from the front portion of the housing, a piston disposed in said cylinder means and adapted to be reciprocated by a linear motion being converted from the rotary motion of said motor by means of a motion conversion mechanism such as a crank mechanism or an eccentric mechanism, an anvil disposed so as to be hit by said piston, a needle supporter for supporting a number of needle chisels for axially slidable movement, and a return compression spring for returning the needle supporter, said piston, said anvil and said needle supporter being adapted to be synchronously reciprocated by means of said motor.

With this type of chisel tool, the electric motor is energized to reciprocate the piston. As the piston advances, it strikes the anvil which in turn hits the needle chisels and the needle supporter to cause the tips of the chisels to work on the surfaces of stone, metal or the like. In such a conventional tool, however, an extremely violent reaction is brought about during the grinding operation, since the motion conversion mechanism of the drive motor is connected in series with the piston to form a serially connected rigid unit. This results in the following disadvantages:

Such a violent reaction gives a great impact directly to the neighboring parts, particularly the electric drive means, resulting in loosening, rattling and/or misaligning of the properly assembled parts to thereby impede smooth operation of the tool. In addition, the various parts of the tool can be adversely affected and may even break down. Especially due to the direct coupling between the electric motor and the motion conversion mechanism, a large reaction causes excessive wear on the rotating and sliding portions of the parts, resulting in greatly reducing the useful life of the tool. Such reaction, as it is naturally transmitted to the hands of the operator, will also fatigue him and be injurious to his health. Moreover, if the operator should accidentally turn on the power switch for the electric motor with the tips of the needle chisels bearing against the surface of stone or metal to be worked on, the components including the chisels, anvil, piston and the motion conversion mechanism would form a single serially interconnected rigid body which would rapidly retract the entire tool toward the operator to subject him to a dangerous reaction.

SUMMARY OF THE INVENTION

Accordingly, it is an object of this invention to provide a novel electrically-operated multi-needle chisel tool wherein reaction from the piston is reduced to a minimum to overcome the aforesaid disadvantages.

Briefly, according to this invention, an intermediate hammer is provided in contrast to the conventional tool of the type described herein in which an anvil is hit directly by a piston. The piston according to the invention includes a base portion and a reduced diameter shaft portion extending forwardly from the base portion. Said hammer which is generally of a hollow cylindrical shape is fitted over the fore end portion of the shaft portion of the piston in opposed relation to the anvil. A buffer compression spring is disposed around the shaft portion between the base portion of said piston and the rear end of said hammer. The buffer compression spring is arranged to begin to be compressed from the moment the hammer strikes the anvil. A return compression spring is disposed in the bore of said hammer around the fore end portion of the shaft portion between the rear end of said bore and a flange member provided on the fore end of the shaft portion. Said buffer compression spring is set to have a greater spring constant than said return compression spring.

With this construction, the shock on the hammer, and hence the piston and the various parts connected therewith is absorbed by the buffer compression spring, so that the reaction from the hammer transmitted ultimately to the operator is also minimized. The return compression spring not only helps the hammer return to its normal position but also serves as a cushion for the hammer against the buffer compression spring during the forward movement of the piston.

The aforesaid and other objects and features of the present invention will become apparent from a reading of the following detailed description with reference to the accompanying drawings, which are given for the purpose of illustration alone, and in which:

FIG. 1 is a side view, partly broken away and partly in cross-section of one embodiment of the electrically operated multi-needle chisel tool according to the present invention, and FIG. 2 is a top plan view, partly broken away of the motion conversion mechanism shown in FIG. 1.

DESCRIPTION OF THE PREFERRED EMBODIMENT OF THE INVENTION

Figure 1:
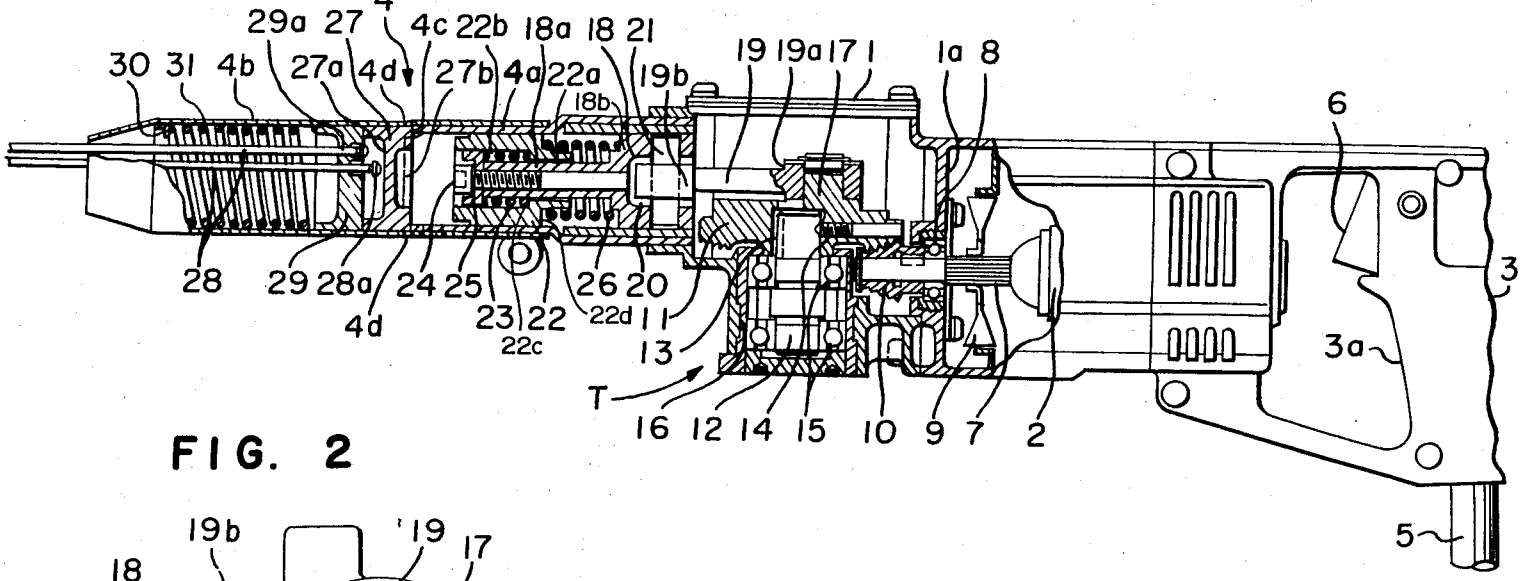

Referring to FIG. 1, the multi-chisel tool according to the invention comprises a housing 1 formed of aluminum or the like having a handle 3 adjacent its rear end. A prime mover in the form of an electric motor 2 is mounted in the rear portion of the housing 1. Connected to and extending forwardly from the fore end of the housing is a cylinder means designated generally by 4.

A power supply cord 5 extends through the handle portion 3 for connection with the motor 2. An on-off switch for the motor 2 is mounted at the upper rear corner of openings 3*a* provided through the opposite sides of the housing 1 so as to define part of the handle 3.

The electric motor 2 has its output shaft 7 extending forwardly through and rotatably journalled by an intermediate partition 1*a* of the housing by means of a bearing 8. Disposed in the housing rearward of the partition 1*a* is a cooling fan 9. Carried by the forward end of the shaft 7 is a bevel gear 10 of a smaller diameter which is in mesh with a larger diameter bevel gear 11 installed in the housing 1 forwardly of the partition 1*a*. The bevel gear 11 is secured to a shaft 12 by means of an anti-rotation key 13 which shaft is in turn rotatably journalled in a pair of axially spaced bearings 15, 15. An anti-withdrawal screw is inserted radially through the bevel gear 11 for engagement with the shaft 12 to prevent axial withdrawal of the shaft.

In the illustrated embodiment, a rigid reinforcing shell made of steel, for example is provided as a reinforcement of the housing 1 to accommodate the bearings 15 so as to maintain the bearings centered even if they are subjected to a heavy load upon an impact exerted on the large diameter bevel gear 11.

Figure 2:
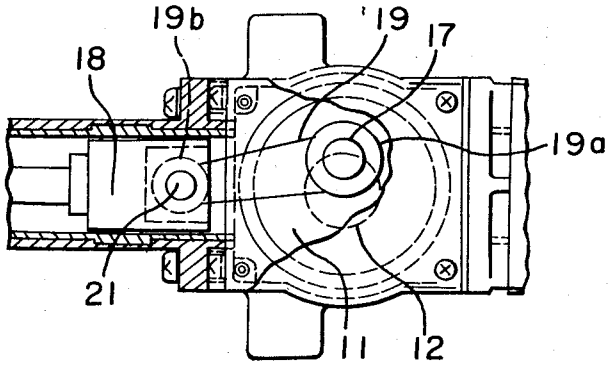

Implanted in the top of the large diameter bevel gear 11 is an eccentric stud shaft 17 as seen in FIG. 2 over which a bearing ring 19*a* at one end of a connected rod 19 is pivotally fitted. The other end of the connecting rod is pivotally connected to a piston 18 which is slidably mounted in the rear portion of the cylinder means 4 for reciprocal movement. Thus, the connecting rod 19 together with the bevel gears 10 and 11 constitutes a rotary-to-linear motion converting mechanism as designated generally by T for converting the rotary motion of the output shaft 7 of the electric motor 2 into a linear motion to effect the reciprocal movements of the piston 18. It is to be appreciated that the present invention is not limited to this type of motion converting mechanism but may utilize an other mechanism including a crank shaft or the like.

The connection between the other end of the connecting rod 19 and the piston 18 may comprise any desired means. In the embodiment illustrated herein, the piston 18 is provided at its rear end with a recess 20 for receiving a bearing ring 19*b* provided at the end of the connecting rod 19. A pivot pin 21 is passed through the rear end of the piston 18 and the ring 19*b* to pivotally connect the piston and the connecting rod.

The piston 18 has a reduced diameter shaft portion 18*a* extending forwardly from its base portion 18*b*. Slidably mounted over the shaft portion 18*a* is a generally cylindrical hammer 22 including a reduced diameter rear portion 22*a* and an enlarged front portion 22*b* having a smaller bore and a larger bore, respectively. A return compression spring 23 surrounding the forward end part of the shaft portion 18*a* is disposed within the larger bore in the hammer 22. The fore open end of the larger bore of the hammer is closed by a flange member 25 secured to the fore end of the shaft portion 18*a* by a screw bolt 24. The spring 23 has thus its opposite ends bearing against the flange member 25 and an inner shoulder 22*c* defined between the smaller and larger bores in the hammer 22.

The spring force of the return compression spring 23 may be regulated by adjusting the extent to which the bolt 24 is threaded into the shaft portion 18*a*. Surrounding the rear end part of the shaft portion 18*a* and the reduced rear portion 22*a* of the hammer is a buffer compression spring 26 having its opposite ends bearing against the front face of the base portion 18*b* of the piston and an outer shoulder 22*d* defined between the reduced rear portion 22*a* and the enlarged front portion 22*b* of the hammer. The buffer spring 26 for the hammer 22 will begin to be compressed the instant that the hammer 22 strikes an anvil 27. The hammer 22 is thus resiliently mounted over the shaft portion 18*a* of the piston 18 and slidably fitted in a rear cylindrical member 4*a* of the cylinder means 4.

The cylinder means 4 further includes a front cylindrical member 4*b* mounted over and extending forwardly from the rear cylindrical member 4*a*. The anvil 27 and a needle supporter 29 are slidably fitted in the front cylindrical member 4*b* which is provided with at least one air vent hole 4*d* adjacent the front end face 4*c* of the rear cylindrical member 4*a*. The anvil 27 has a smaller weight (mass) than the hammer 22 and is adapted to be struck by the hammer. The anvil 27 has a front recessed portion 27*a* in its front end for accommodating the rear ends of a number of needle chisels 28 and a rear recessed portion 27*b* in its rear end for preventing the head of the bolt 24 from hitting the anvil.

The needle supporter 29 is smaller in weight (mass) than the anvil 27 and is adapted to support a number of needle chisels 28 individually for axial sliding movements. Disposed in the front cylindrical member 46 between the front end of the needle supporter 29 and an annular flange 30 fixed to the inner peripheral wall of the cylindrical member 4*b* adjacent its forward end is a return compression spring 31 for urging the needle supporter 29 toward the anvil.

The needle chisels 28 supported by the needle supporter 29 have anti-withdrawal enlarged heads 28*a* at their rear ends adapted to be struck by the anvil 27. Preferably, the front faces of the enlarged heads 28*a* may be of frusto-conical shape and the rear end portions of the bearing bores 29*a* for the needle chisels may be of complementarily frusto-conical shape.

In operation, the cord 5 is first connected to a power source (not shown) and the switch 6 is turned on to energize the electric motor 2.

The rotary motion of the motor 2 is converted into a linear motion by means of the motion conversion mechanism T as described above to reciprocate the piston 18 in the cylinder means 4.

It is to be noted at this point that as the piston 18, hence the shaft portion 18*a* thereof advances, the forward movement of the piston is substantially correspondingly transmitted to the hammer 22 by means of the buffer compression spring 26 to rapidly move the hammer forward while the return compression spring 23 is compressed since the buffer spring 26 has a greater spring constant than that of the return spring 23. Upon the forward movement, the hammer 22 strikes the anvil 27 vigorously which in turn moves the needle chisels 28 while at the same time the striking power of the hammer is transmitted through the anvil 27 to the needle supporter 29 to advance the latter against the spring force of the return spring 31.

The impacting of the hammer 22 on the anvil 27 takes place just before the connecting rod 19 reaches its upper dead center. The buffer spring 26 begins to be compressed the instant that the hammer 22 impacts on the anvil 27 and remains compressed until the hammer reaches its farthest advanced position, whereby the shock on the hammer and hence a part of the reaction by the hammer are effectively absorbed by the buffer spring 26. Consequently, the heavy reaction by the hammer is prevented from being transmitted to the piston 18 and the associated parts and thence to the operator.

The return compression spring 23 is further compressed instantaneously when the hammer 22 hits the anvil 27 during the forward movement of the hammer, so that as the connecting rod 19 of the motion conversion mechanism T beings to move toward its lower dead center, the restoring power of the return spring 23 in synchronism with the retraction of the piston 18 serves to return the hammer quickly. It is to be understood that the return spring 23 also has a buffering action on the forward movement of the hammer since the spring is appropriately compressed during the foreward movement of the hammer.

The operation of the needle chisels 28 will now be described.

As described above, the hammer strikes the anvil 27 which in turn successively hits the heads 28*a* of the needle chisels 28 which are axially unevenly projecting from the rear end face of the needle supporter 29. This results in rapid forward movement of the chisels 28 loosely supported in the associated holes 29*a* in the needle supporter ahead of the needle supporter.

Just after the anvil 27 has struck the chisels 28, the needle supporter 29 is also hit by the anvil to be moved forward, whereby the individual chisels are rapidly advanced independently of each other to grind the surface of a workpiece such as metal or stone material with their tips.

As the needle supporter 29 advances, the return compression spring 31 is compressed in a moment. Thus, when the needle supporter 29 advances to its foremost position, it is returned to its original position by the increased restoring power of the spring 31. The needle chisels 28 are moved back under the force of inertia ahead of and faster than the needle supporter 29. At this time the anvil 27 is moved back to a position just forward of the front end face 4*c* of the rear cylindrical member 4*a*.

From the foregoing description it is to be appreciated that the present invention provides a novel electrically-operated multi-needle chisel tool which is capable of producing a strong impact force and yet minimizing the shock exerted on the operator, characterized by the piston 18 connected directly with the motion conversion mechanism T and including a base portion 18*b* and a reduced diameter shaft portion 18*a* extending forwardly from the base portion, a hollow generally cylindrical hammer 22 axially slidably fitted over the fore end portion of the shaft portion of the piston in opposed relation to the anvil 27, a buffer compression spring 26 disposed around the shaft portion between the base portion of said piston and the rear end of said hammer, said buffer compression spring being arranged to begin to be compressed from the moment the hammer strikes the anvil, and a return compression spring 23 disposed in the bore of said hammer around the fore end portion of the shaft portion between the rear end of said bore and a flange member provided on the fore end of the shaft portion, said buffer compression spring having a greater spring constant than said return compression spring.

The buffer compression spring 26 makes the full use of the stroke of the piston 18. The striking of the anvil 27 by the hammer 22 takes place just before the piston 18 reaches its forwardmost position. After the striking, the piston continues to advance a short distance prior to starting to retract.

The buffer compression spring 26, performs its buffering function upon the termination of the forward movement of the piston 18 and during the retraction of the piston, while the return compression spring 23 acts to return the hammer 22 to its original position. The buffering compression spring 26 is interposed between the piston 18 and the hammer 22 provided separately from each other to permit the two members 18 and 20 to relieve each other of the shocks exerted thereon. The spring 26 also prevents a heavy shock being transmitted to the operator when the tool is abruptly energized by an accident or error.

While the present invention has been described with reference to the preferred embodiment, it is to be understood that many changes or modifications may be made without departing from the scope as defined in the appended claims.

What is claimed is:

1. An electrically-operated multi-needle chisel tool comprising:

a housing having a front portion and a rear portion;

an electric motor mounted in said rear portion;

a cylinder means extending forwardly from the front portion of the housing;

a piston disposed in said cylinder means and adapted to be reciprocated by a linear motion being converted from the rotary motion of said motor;

an anvil axially slidably supported in said cylinder means and positioned forward of the piston so as to be hit by said piston;

a needle supporter axially slidably supported in said cylinder means and positioned forward of the anvil so as to be hit by said anvil;

a number of needle chisels individual supported by said needle supporter for axially slidable movement;

a return spring disposed in said cylinder means for returning the needle supporter;

said piston, said anvil and said needle supporter being adapted to be synchronously reciprocated by means of said motor;

said piston including a base portion and a reduced diameter shaft portion extending forwardly from the base portion;

a hollow generally cylindrical hammer axially slidably fitted over the fore end portion of the shaft portion of the piston in opposed relation to said anvil;

a buffer compression spring disposed around the shaft portion between the base portion of said piston and the rear end of said hammer, said buffer compression spring being arranged to begin to be compressed from the moment the hammer strikes the anvil; and a return compression spring disposed in the bore of said hammer around the fore end portion of the shaft portion between the rear end of said bore and a flange member provided on the fore end of the shaft portion, said buffer compression spring having a greater spring constant than said return compression spring.

2. An electrically-operated multi-needle chisel tool according to claim 1, said flange member being secured to said fore end portion of said shaft portion of the piston for retaining said return compression spring relative to said bore of said hammer and said shaft portion of said piston.

3. An electrically-operated multi-needle chisel tool according to claim 2, wherein said flange is secured by a bolt to said shaft portion of said piston and said anvil includes a recess for accommodating a head portion of said bolt to prevent collision.

* * * * *